United States Patent [19]

Friedman et al.

[11] Patent Number: 4,747,478

[45] Date of Patent: May 31, 1988

[54] COIN SORTER AND TOTALIZER

[75] Inventors: Evelyn Friedman, P.O. Box 149, Whitehall, N.Y. 12887; William R. Carswell, Whitehall, N.Y.; Martin A. Borho, Whitehall, N.Y.; Nicholas J. Frandino, Whitehall, N.Y.

[73] Assignee: Evelyn Friedman, Whitehall, N.Y.

[21] Appl. No.: 838,526

[22] Filed: Mar. 11, 1986

Related U.S. Application Data

[63] Continuation-in-part of Ser. No. 489,848, Apr. 29, 1983, Pat. No. 4,592,461.

[51] Int. Cl.[4] ..... G07F 3/04; G07F 11/04

[52] U.S. Cl. ..... 194/227; 194/346; 453/5

[58] Field of Search ..... 194/226, 227, 233, 248, 194/346, 345; 133/3 R, 3 C, 3 D; 453/5, 9, 15

[56] References Cited

U.S. PATENT DOCUMENTS

| | | | |
|---|---|---|---|
| 2,339,823 | 1/1944 | Vogel | 194/332 |
| 3,126,082 | 3/1964 | Maxwell | 194/232 |
| 3,149,709 | 9/1964 | Schuller | 194/227 |
| 4,000,799 | 1/1977 | Knickerbocker | 194/227 |
| 4,227,604 | 10/1980 | Chalabian | 194/338 |
| 4,263,924 | 4/1981 | Johnson | 133/3 C |
| 4,382,499 | 5/1983 | Christian | 194/1 L |
| 4,421,219 | 12/1983 | Christian | 194/225 |

*Primary Examiner*—F. J. Bartuska
*Attorney, Agent, or Firm*—Edgar N. Jay

[57] ABSTRACT

A coin sorter is described for sorting coins of different denominations by means of ramps and flaps, the sorted coins being directed to different chutes, one chute being provided for each coin denomination, the chutes and coin exit openings at the ends of chutes as well as the ramps being formed in two complementary parts of the coin sorter. The sorter may be provided either in a coin operated assembly for use in an existing coin operated vending machine or in a new machine and in either case is best used in conjunction with a coin totalizer having a ratchet wheel, a price cam and at least two circular cams, the price cam and circular cams being rotatable with the ratchet wheel when the latter is rotated by a trip wire-lever, the degree of rotation being determined by the chute through which a given coin passes. The assembly is further provided with an operating and a reset lever operable to reset the coin totalizer after dispensing a commodity from the machine in response to insertion of the correct amount of coins. Also described is a lock-out mechanism which prevents the return of coins if a purchaser operates a coin return button of the machine simultaneously with the attempted opening of a front door of the machine after depositing the correct coins required for vending the commodity.

12 Claims, 10 Drawing Sheets

COIN SORTER AND TOTALIZER

BACKGROUND OF THE INVENTION

The present application is a continuation in-part of U.S. application No. 489,848 filed Apr. 29, 1983, now U.S. Pat. No. 4,592,461. granted June 3, 1986.

The present invention relates to coin operated vending machines for dispensing a commodity on insertion to a coin slot in the machine a predetermined amount of coins. For ease of disclosure, the invention will be described in connection with the vending of a newspaper commodity, although obviously not so limited.

Many of the coin operated dispensing machines now in use employ stacking devices which stack inserted coins edgewise in one or more coin chutes. With such stacking devices, the vertical length of the coin chutes are limited by available space and hence the selling price of a commodity is likewise limited. In place of such stacking devices it has been known to use a totalizer means capable of registering a large amount of coins to control the dispensing of a desired commodity; see U.S. Pat. No. 4,000,799 issued Jan. 4, 1977.

U.S. application No. 489,848 filed Apr. 29, 1983 and assigned to the assignee hereof discloses a totalizer means comprising a coin sorter-totalizer combination which also represents a marked improvement over the mentioned coin operated stacking devices.

The problem with which the present invention is concerned is the upgrading of presently available coin operated vending machines having stacking devices by replacing such stacking devices with a coin operated totalizer means for extending the price range of commodities otherwise limited by presently available stacking devices. The problem is aggravated by the fact that no presently available totalizer means can be used for this purpose. For example, the totalizer means (here used broadly to encompass the entire assembly of parts required for dispensing a commodity and comprising a sorter, a totalizer and a vending controller as hereinafter more fully disclosed) must fit in the space bounded by the coin slot of the vending machine in which the stacking device is to be replaced, the coin return outlet and the front door latch of such vending machine, which door latch is to be released on insertion of the proper amount of coins in the coin slot. Totalizer means presently available are too large to fit within the indicated space and this is true of the totalizer means of U.S. Pat. No. 4,000,799 and that described in the mentioned U.S. application No. 489,848, the disclosure of which is incorporated by reference.

SUMMARY OF THE INVENTION

The problem referred to is solved, in accordance with the invention, by providing, among other parts, a novel coin sorter which consumes minimal space especially in vertical direction, and which may generally be used with the totalizer assembly of U.S. application Ser. 489,848. Advantageously, both the coin sorter and totalizer assembly are provided in a housing which mounts all the necessary parts for performing the various functions of the vending machine; i.e. release of the front door latch on totalizing coin deposits in a predetermined amount, resetting of the totalizer (a) on opening the front door for removing a commodity or (b) on operating a coin release button, collecting the coins in an escrow container on opening the vending machine front door or routing the coins in the escrow container to a coin return receptacle on actuating a coin return button. In referring to the "front door" reference is being made to the door at the front of the vending machine through which newspapers may be inserted or removed. The housing containing the parts above referred to is suitably mounted to the rear side of the front wall of the head part of the vending machine more specifically hereinafter described.

DETAILED DESCRIPTION OF THE INVENTION

Figure 1:
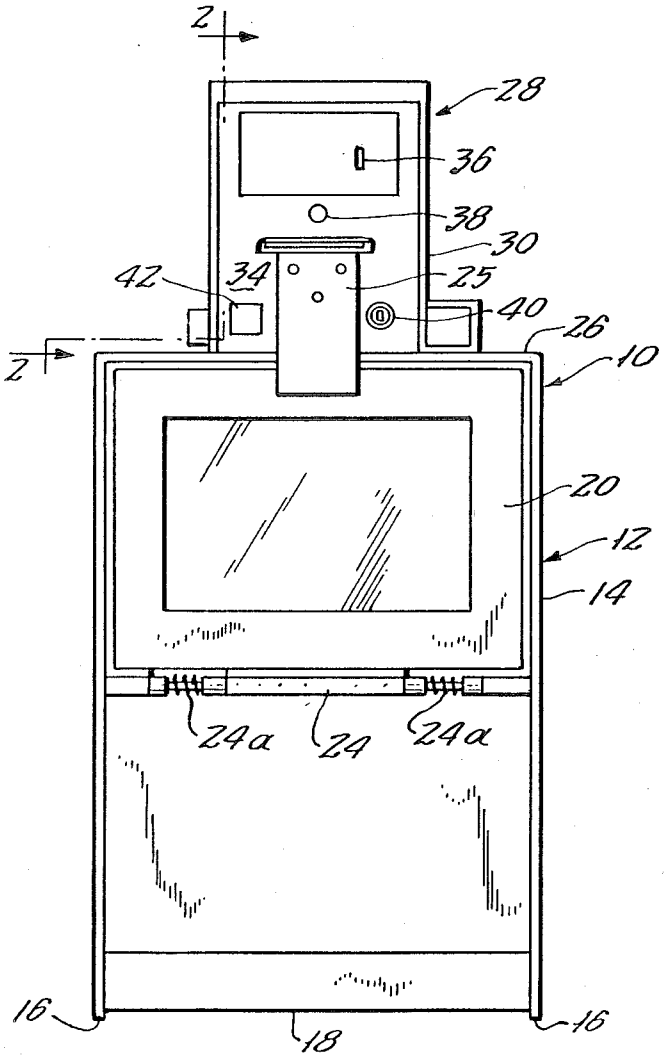
FIG. 1 is a front elevation view of a vending machine in accordance with the invention.

Shown in FIG. 1 is a vending machine, generally 10 of this invention. The vending machine 10 has a conventional lower housing, generally 12. The housing 12 comprises a lower enclosure 14 formed by substantially rectangular metal walls. The enclosure 14 is supported by a plurality of legs 16 attached to its base 18. The enclosure 14 is adapted to hold, for example, a stack of newspapers, periodicals or the like (not shown) within it. A conventional rectangular front door 20 is attached to the front wall of the enclosure 14 by a plurality of hinges 24 along the lower edge of the door 20 and is urged into closed position by spring means 24*a*. An upwardly extending member or extension 25 of the door serves as a handle for the door. The door 20 can be opened to allow a stack of newspapers or the like to be placed in the enclosure 14 and to allow a purchaser of a newspaper or the like to remove one of the newspapers from the enclosure 14.

Attached to top wall 26 of the lower enclosure 14 is a conventional head part, generally 28. The head part 28 comprises an upper enclosure 30 formed by substantially rectangular metal walls. The upper enclosure 30 is adapted to have the coin operated assembly and related parts mounted within it.

Figure 2:
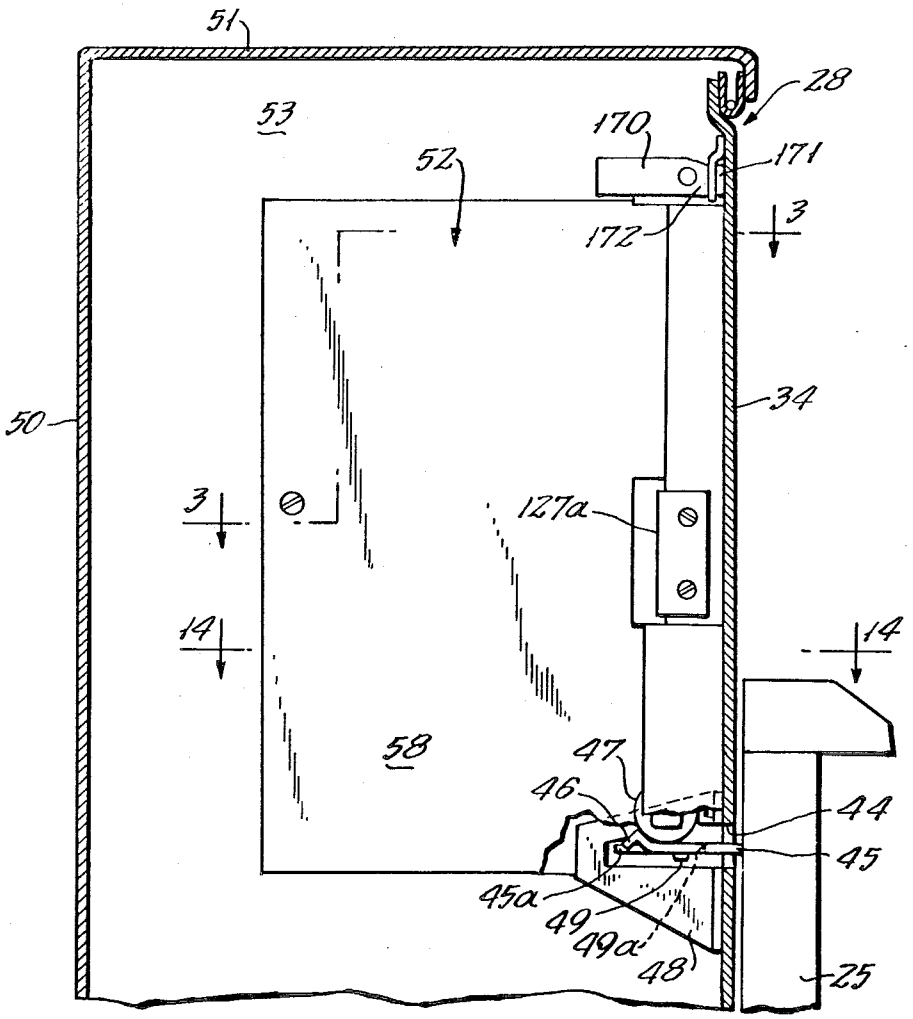
FIG. 2 is a section view along line 2—2 in FIG. 1.

As shown in FIG. 1, the front wall 34 of the upper enclosure 30 is provided with the following conventional elements: a coin insert slot 36, a coin return button 38, a price selector lock 40 and a coin return opening 42. The front wall 34 has an opening 44 (see FIG. 2) through which passes a conventional door latch 45 carried by extension 25. The lateral forward ends 46 of latch 45 are beveled (only one beveled end being seen in FIG. 2) for camming action of cooperating members during movement of latch 45 through opening 44 into the head part 28. In FIG. 2, the illustrated beveled end 46 cooperates with a roller 47 for a purpose more fully hereinafter described. The head part 28, as known, is provided with a hook 48 having an extension 49 received in a centrally located opening **49*a* in latch 45 when the front door is in locked position. It is to be understood that latch 45 and hook 48** form part of the vending machine adapted for operation with the coin operated assembly of the invention.

Access to the inner confines of the upper enclosure 30 may be had by removing the rear cover 50 with its top extension 51. The coin operated assembly is housed in an open-bottom housing, generally 52, the front wall 55 of which has a coin receiving slot 36' (see FIG. 19). It is to be understood that when the housing is mounted to the rear side of the front wall 34 of the head part 28, the coin receiving slot in the housing will be in alignment with the coin receiving slot 36 in the head part 28 and roller 47 will be in contact with latch 45 when the front door is closed as shown in FIG. 2. The latch is upwardly biased by spring means (not shown) to ensure positive locking action of hook 48 and latch 45.

Figure 3:
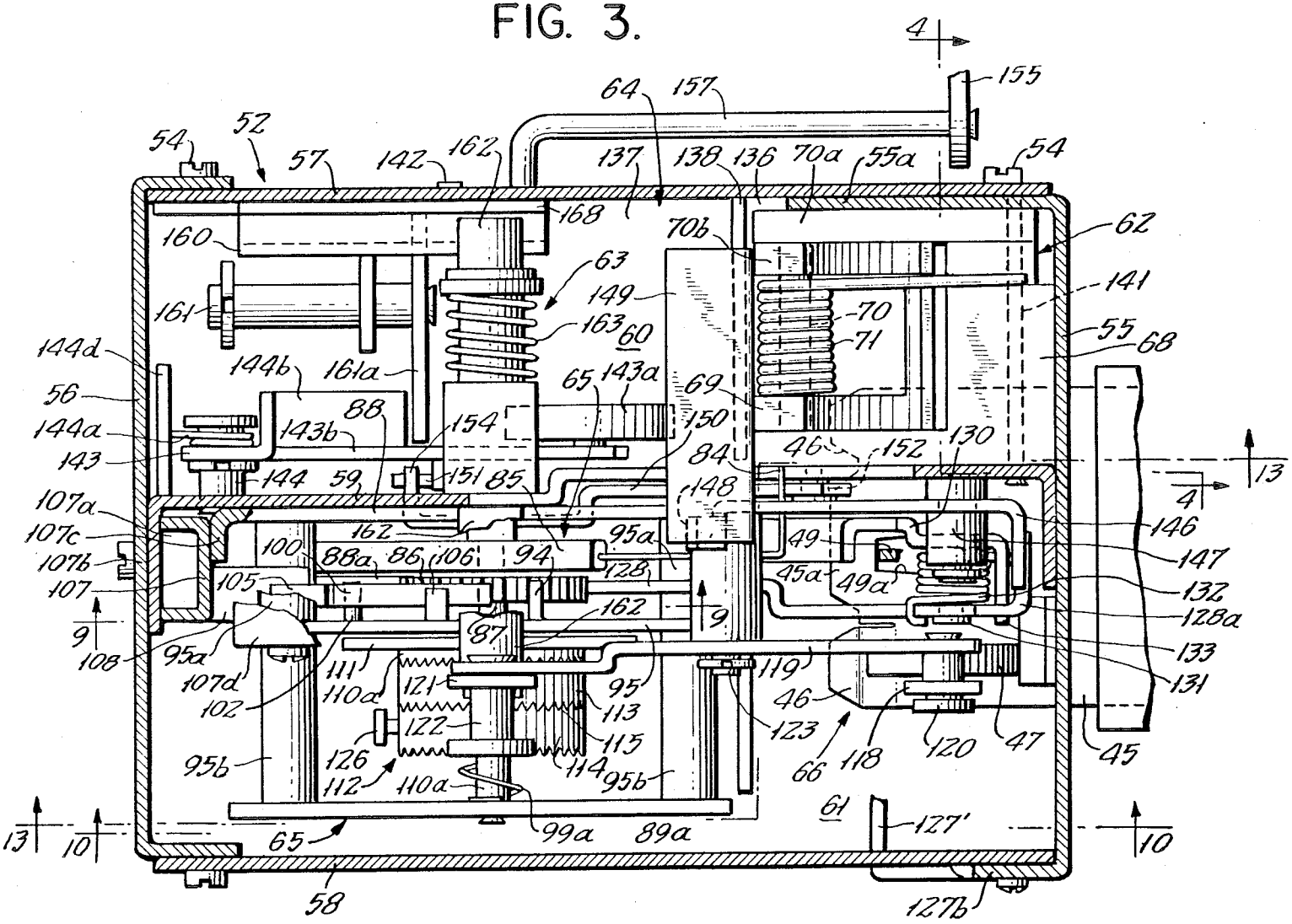
FIG. 3 is a section view along line 3—3 in FIG. 2.

Referring to FIG. 3, the housing 52 comprises four metal wall parts which when joined by screws 54 define a substantially rectangular enclosure having a front wall 55, a rear wall 56 and side walls 57, 58. The front wall 55 serves as a frame together with a divider plate 59 midway between the side walls 57, 58 for mounting the parts of the coin operated assembly. The divider plate 59 divides the housing into first and second compartments 60 and 61, respectively. Compartment 60 contains a coin sorter, generally 62, alternate price control means, generally 63 and an escrow coin receiver, generally 64, below the coin sorter. Compartment 61 contains the coin totalizer, generally shown at 65 and parts of a vending control means, generally shown at 66 which prevents unlatching of the front door 20 until the correct amount of coins have been inserted in the slot 36.

Figure 5:
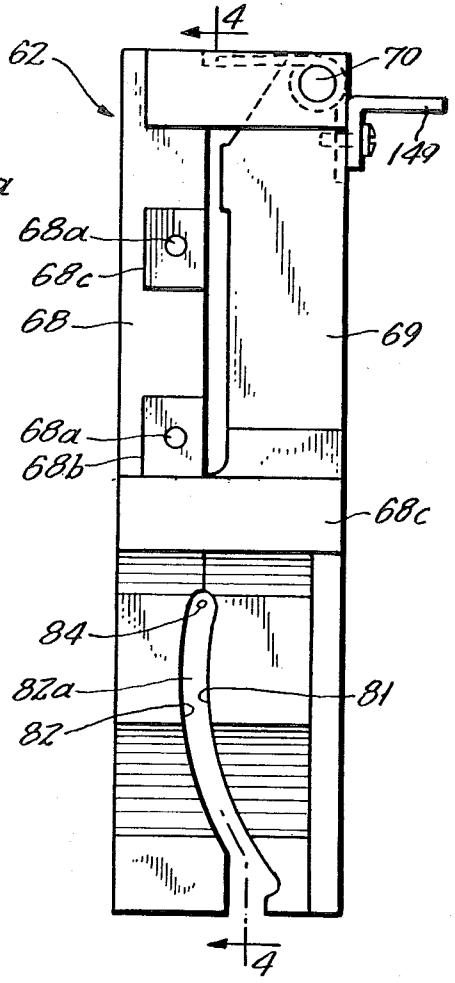
FIG. 5 is a side view of the coin sorter in accordance with the invention comprising the front part and a rear part mounted for pivotal movement relative to the front part which displays two threaded mounting holes for attaching the front part of the coin sorter within and to a wall of the housing.

The coin sorter 62 is secured to the housing 52 within compartment 60 in the front end portion thereof for alignment of its slot 67 (see FIG. 4) with slot 36 in head part 28. As seen in FIGS. 3 and 5, the coin sorter comprises two parts, namely a front part 68 and a rear part 69 interconnected by pin means 70 extending through overlapping ears **70*a*, 70*b* of the front and rear parts, respectively. Spring means 71 surrounding the pin means 70 urges the rear part 69 against the front part 68, yet permits pivotal movement of the rear part 69 relative to the front part about pin means 70**.

The sorter is vertically oriented within compartment 60 of housing 52, as will be appreciated from FIG. 3, and is fixed within the latter by screws (not shown), passing through openings (not shown) in a flange formation **55*a* of the front wall 55, for threaded engagement with threaded openings 68*a* in spaced bosses 68*b* in the side wall of the sorter front part 68. As thus mounted the sorter front part is immovably fixed to the front wall flange 55*a* while the rear sorter part 69 may pivotally be moved about the pin means 70 when urged against the bias of the spring means 71 in a direction away from the front sorter part 68. The front sorter part, on a side thereof in which the threaded openings are provided, has a rearwardly extending guide finger 68*c*** for guiding pivotal movement of the rear sorter part relative to the front sorter part. The front and rear sorter parts may be die cast metal parts of, for example, a zinc alloy.

Figure 4A:
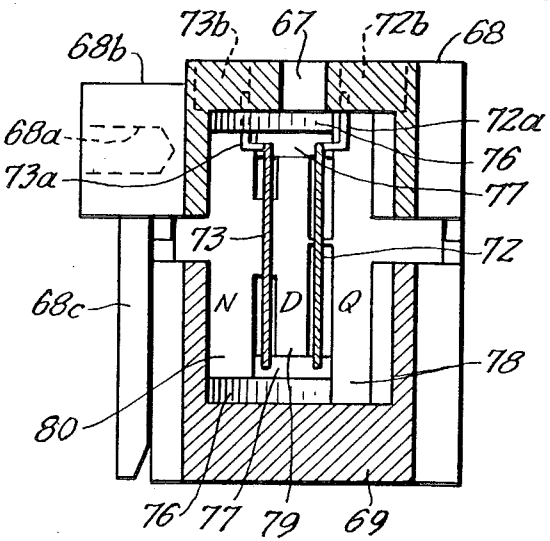
FIG. 4A is a section view along line 4A—4A in FIG. 4.
Figure 4:
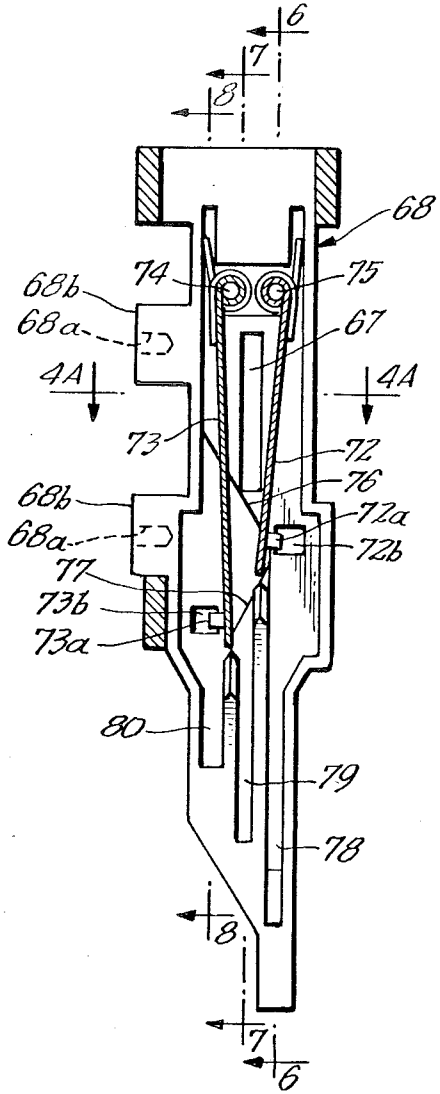
FIG. 4 is a section view along line 4—4 in FIGS. 3 and 5 and shows the rear side of the front part of the two part coin sorter in accordance with the invention.

As seen in FIG. 4, which shows the rear side of the front part 68 of the sorter 62, a pair of longitudinally extending flaps 72, 73 are spring urged toward each other, flap 73 being mounted on a counter-clockwise acting spring-pin combination 74 and flap 72 being mounted on a clockwise acting spring-pin combination 75. For convenience, flap 72 will be referred to as the quarter flap and 73 as the nickel flap.

Below slot 67 is formed an inclined quarter ramp 76 and an inclined nickel ramp 77, the quarter and nickel ramps being inclined in opposite directions and extending in planes which intersect at an angle of about 120 degrees. Below the two ramps 76 and 77 are provided three chutes, a quarter chute 78, a dime chute 79 and a nickel chute 80. On deposit of a quarter coin through slot 67, the quarter will drop down the vertically oriented sorter between flaps 72, 73 until it strikes ramp 76. The quarter is then guided into the quarter chute by ramp 76 (and a corresponding ramp in the rear part 69 of the sorter 62) and also by the bottom of flap 72 which is moved counterclockwise about spring-pin combination 75 during passage of the quarter into its chute 78. Counterclockwise and clockwise movement of flap is limited by a downwardly extending projection **72*a* from flap 72 and by opening 72*b* in which the projection 72*a* moves when flap 72 is moved about the spring-pin combination 75**.

On deposit of a nickel coin through slot 67, the nickel will fall between flaps 72, 73 until it strikes ramp 77. The nickel is then guided into the chute 80 by ramp 77 (and a corresponding ramp in the rear part 69 of the sorter 62) and also by the bottom end portion of flap 73 which is moved clockwise about spring-pin combination 74 during passage of the nickel into its chute 80. A dime deposited through slot 67 because of its smaller size will freely fall between the flaps 72, 73 and will be guided thereby into the dime chute 79. As seen in FIG. 4, flap 73 also has formed thereon a downwardly extending projection **73*a* which is received in opening 73*b*, the side walls of which limit clockwise and counterclockwise movement of flap 73** about its associated spring-pin combination.

FIG. **4*a* shows the ramps 76 and 77 formed in the front 68 and rear 69 sorter parts for respectively guiding nickels and quarters into chutes 80 and 78. As will be seen in FIG. 4*a*, the width of the ramps 76 and opening between the ramps is such as to "capture" and guide only quarters to chute 78. Nickel coins being smaller than quarters will fall through the opening between ramps 76 and will be "captured" by ramps 77 which guide the nickel coins to chute 80**.

When a 10 cent coin is inserted through slot 67, because this coin is smaller than a nickel coin, it will freely fall between flaps 72, 73 and ramps 76 and 77 into its chute 79. It is a feature of this invention that all the coins are directed to their chutes without flipping of the coins, as occurs, for example, in the aforementioned U.S. application Ser. 489,848, that is, the coins emerge from the sorter in the same orientation as inserted in slot 67.

The coin chutes will be seen to be an integral part of the coin sorter thereby providing a compact structure making possible the substitution for the coin stacking device of an existing vending machine the coin operated totalizer of the invention.

Figure 8:
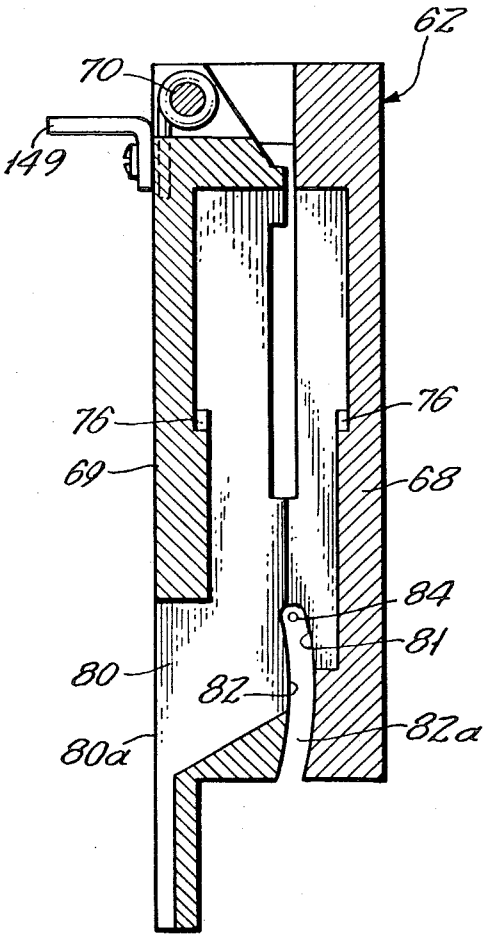
FIGS. 6, 7 and 8 are section views of the two part coin sorter of FIG. 5 taken, for clarity of illustration, along lines 6—6, 7—7 and 8—8 respectively through the front sorter part only of FIG. 4.
Figure 7:
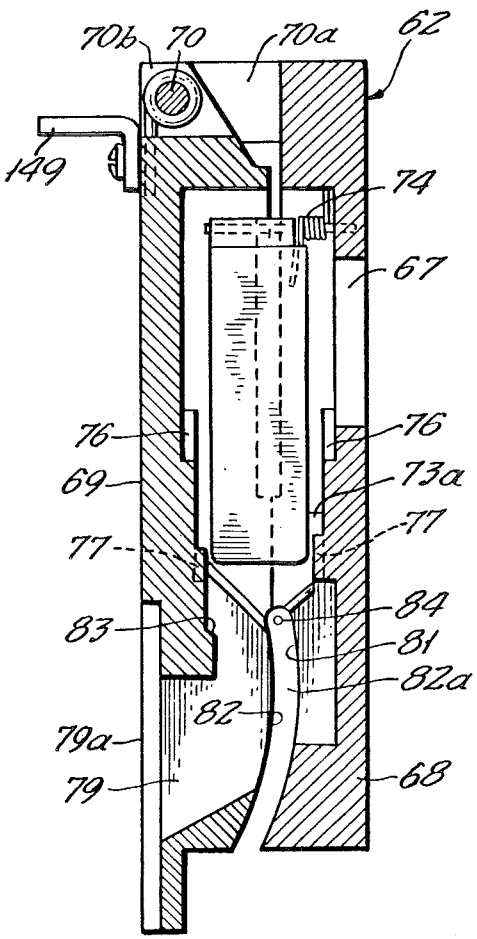
Figure 6:
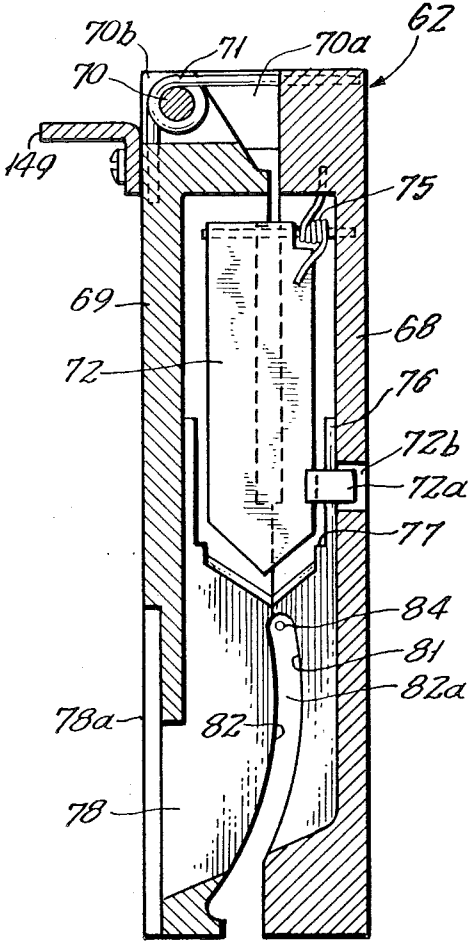

FIGS. 6, 7 and 8 are to be understood to be vertical sections of the two sorter parts in assembled relation notwithstanding that FIG. 4 shows vertical sections taken through only the front part 68 of the sorter. As best seen in FIGS. 6, 7 and 8, the rear wall 81 of the front part 68 and the front wall 82 of the rear part are relieved to define a generally downwardly directed arcuate space 82*a* extending through the bottom of the front and rear parts of the sorter. The quarter and nickel ramps 76 and 77, respectively, are shown in FIG. 7 which also shows a ramp 83 which, while enabling passage of a dime coin to its chute 79, will block passage of a larger coin of a size intermediate that of a nickel and a dime coin, for example, a penny coin because the space while large enough for a dime is too small for a penny to pass. A penny coin if inserted through the coin slot 67 and jammed in the sorter may be removed as hereinafter described.

Still referring to FIGS. 6, 7 and 8, it will be appreciated from what has been described, that although nickel, dime and quarter coins are inserted in a common slot 67, each is immediately sorted and travels downwardly under its own weight along different short paths, without flipping, for discharge through their respective chutes 78, 79, 80 and openings 78*a*, 79*a*, 80*a* in the rear side of the rear part 69 of the sorter. The coins exiting openings 78*a*, 79*a* and 80*a* fall into an escrow receiver as hereinafter described. It should also be noted that the front and rear sorter parts 68, 69 are constructed to insure different lengths of arcuate travel of a trip wire 84 in the space 82*a* as a function of the coin value deposited in sorter slot 67. For example, as seen in FIGS. 6, 7 and 8, a nickel coin (FIG. 8) will move the trip wire 84 within space 82*a*, a predetermined distance before entering chute 80, which movement is registered in the totalizer 65 as a nickel coin deposit in slot 67. A dime coin (FIG. 7) will move the trip wire 84 within space 82*a* a distance greater than moved by the nickel coin before entering chute 79, the dime coin movement of the trip wire 84 being registered in the totalizer 65 as a dime coin deposit in slot 67. A quarter coin (FIG. 6) will move the trip wire the greatest distance within space 82*a*, before entering chute 78, the quarter coin movement of the trip wire 84 being registered in the totalizer 65 as a quarter coin deposit in slot 67.

As noted, the different extent of arcuate movement of the trip wire 84 is registered in the coin totalizer 65 as different coin deposits; i.e. 5 cent, 10 cent or 25 cent coin deposits. The coin totalizer 65 shown in FIG. 3 (including the vending control of the application) is essentially the totalizer-vending control 80, 81 shown in FIGS. 5, 6, 7 and 9 of U.S. application Ser. No. 489,848 (except as modified as hereinafter disclosed) and therefore will only generally be described herein to the extent deemed necessary for an understanding of its operation in conjunction with the coin sorter of the invention.

Figure 9:
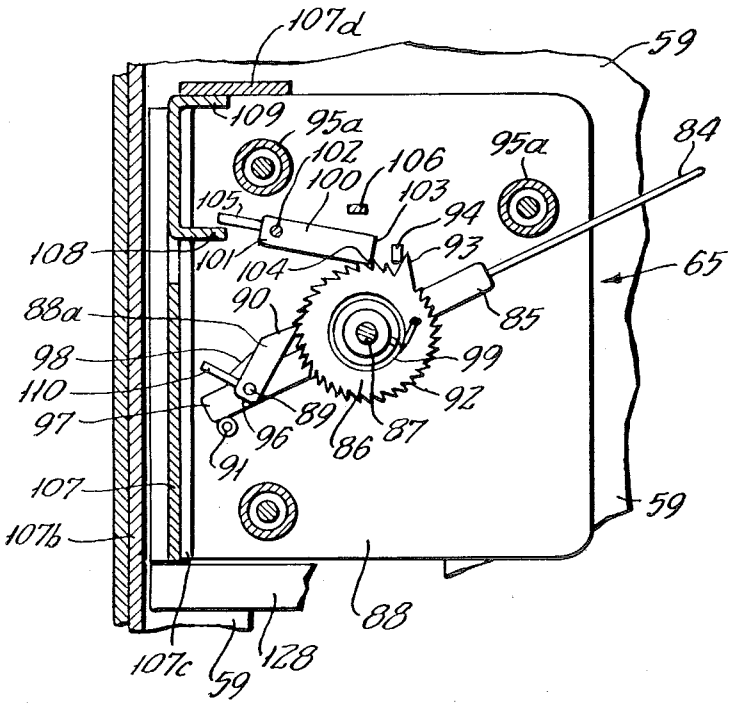
FIG. 9 is a section view along line 9—9 in FIG. 3.

Referring to FIGS. 3 and 9, the totalizer 65 comprises a lever 85 (corresponding to lever 104 of the mentioned pending application) one end of which is counter weighted and the other end of which is connected to the trip wire 84. As seen in FIGS. 3 and 9 (the latter figure being essentially a duplication of FIG. 6 of the mentioned U.S. application) a ratchet wheel 86 is rotatably mounted on a rod 87 rotatably supported between front plate 88, fixed to divider plate 59, and retaining plate 89*a*. The lever 85 is also rotatably mounted on rod 87 and is adapted to rotate the ratchet wheel 86 a distance corresponding to the arcuate movement of the trip wire 84 by coins deposited in the sorter 62 as hereinbefore described. To this end, adjacent the counterweighted end of the lever 85, a lower dog 88*a* is mounted for rotation on pin 89 (see FIG. 9). The other end 90 of the dog 88*a* is beveled downwardly and laterally from the top of the dog 88 as shown in FIG. 9, and the beveled end 90 extends rearwardly from the front of the dog 88*a* to about its middle. A stop 91 is provided on front plate 88 below the counterweighted end of the lever 85. The stop 91 restricts counterclockwise rotation of the lever 85 about rod 87 (when viewed as in FIG. 9). Because the one end of the lever 85 is counterweighted, that end rests on top of the stop 91 below rod 87 whereas the opposite end of the lever is above rod 87, this position being assumed when no coin is in coin chutes 78, 79 or 80.

As seen in FIG. 9, the ratchet wheel 86 has a plurality of gear teeth, generally 92, about its circumference. The beveled end 90 of the dog 88*a* is adapted to engage the gear teeth 92 of the ratchet wheel 86 and to urge the gear teeth 92 to revolve clockwise with the dog 88*a* about the central rod 87 (when viewed as in FIG. 9). As explained in the mentioned U.S. application, the beveled end 90 of the dog 88 is preferably adapted to contact only the front portions of the gear teeth 92 on the ratchet wheel 86 and, when the lever 85 and the ratchet wheel 86 are not in motion, to fit between adjacent gear teeth 92.

As seen in FIG. 9, one of the gear teeth 93 on the ratchet wheel 86 is higher than the rest and serves as a stop to limit counterclockwise rotation of the ratchet wheel 86 (viewed as in FIG. 9) when gear tooth 93 strikes a tab 94 (see FIG. 9) on plate 88 during counterclockwise rotation of ratchet wheel 86. Plate 95 is provided between plates 88 and 89*a* and is spaced therefrom by spacers 95*a* and 95*b*.

As explained in the mentioned pending U.S. application, several gear teeth on the ratchet wheel 86 do not extend all the way from the rear to the front of the ratchet wheel. Such gear teeth extend only from the rear to about the middle of the ratchet wheel and are located somewhat to the rear of the beveled end 90 of dog 88. These half-gear teeth form a gap between the gear teeth 92 at the front of the ratchet wheel 86. The beveled end 90 of the dog 88*a*, which contacts only the front portions of the gear teeth 92, can not contact the half-gear teeth and cannot urge such gear teeth to move clockwise (when viewed as in FIG. 9) with the beveled end 90 of the dog 88*a*.

The dog 88*a* is adapted to move upwardly and to revolve clockwise a measured angle about the central rod 87 (when viewed as in FIG. 9) with the adjacent counterweighted end of the lever 85 when the trip wire 84 and the other end of the lever 85 are moved downwardly and are revolved clockwise a measured angle about the central rod 87 (when viewed as in FIG. 9). Such upward movement and clockwise revolution of the dog 88*a* about the central rod 87 initially causes its beveled end 90 to abut against the bottom of the gear tooth 92, directly above it on the ratchet wheel 86. This causes the beveled end 90 of the dog 88*a* to revolve in a clockwise direction (when viewed as in FIG. 9) about the pin 89, until the bottom of a finger (not shown) on the front of dog 88*a* engages lever 85. Further, such upward movement and clockwise revolution of the dog 88*a* causes its beveled end 90 to move with its other end 96 and the adjacent counterweighted end 97 of the lever 85, so that the top of the beveled end 90 of the dog 88*a* urges the gear tooth 92, to revolve a measured angle about the rod 87 in a clockwise direction (when viewed as in FIG. 9).

As further disclosed in the mentioned pending application, dog 88*a* is also adapted to move downwardly and to revolve counterclockwise a measured angle about the rod 87 (when viewed as in FIG. 9) with the adjacent counterweighted end 97 of the lever 85 when the trip wire 84 and the other end of the lever 85 move upwardly and revolve counterclockwise about the central rod 87 (when viewed as in FIG. 9) under the weight of the counterweighted end of the lever. Such downward movement and counterclockwise revolution of the dog 88*a* can occur until the counterweighted end of lever 104 comes to rest on the stop 91. This downward movement and counterclockwise revolution of the dog 88*a* causes the bottom of its beveled end 90 initially to abut against the top of the gear tooth 92, directly below it on the ratchet wheel 86. This causes the beveled end 90 of the dog 88*a* to revolve in a counterclockwise direction (when viewed as in FIG. 9) about the pin 89, mounted on its other end 96, until its beveled end 90 has revolved counterclockwise out from between the pair of gear teeth 92 where it had been positioned and the top of its finger (not shown) on the front of dog 88*a* abuts against the bottom of a dog retaining spring 98. Further such downward movement and counterclockwise revolution of the dog 88*a* causes the bottom of its beveled end 90 to move downwardly along the tops of the gear teeth 92 and the circumference of the ratchet wheel 86 until the dog 88*a* stops with the lever 85 on the stop 91. Then, the beveled end 90 of the dog 88*a* moves downwardly and revolves clockwise (when viewed as in FIG. 9) about the pin 89 under the weight of its beveled end 90, so that its beveled end 90 falls downwardly between another pair of gear teeth 92. The ratchet wheel 86 does not rotate about the rod 87 during such downward movement and counterclockwise revolution of the dog 88*a* about the rod 87 for reasons which will become apparent from the disclosure to follow.

Suitably mounted to the ratchet wheel 86, is a torsion spring 99 which is adapted to rotate the ratchet wheel 86 about the rod 87 in a counterclockwise direction (when viewed as in FIG. 9) when the ratchet wheel 86 is not so restrained from moving by dog 88*a*.

As seen in FIG. 9, the totalizer 65 also comprises an upper dog 100 above the rod 87 and dog 88*a* and on the same lateral side of the rod 87 as the dog 88*a*. The upper dog 100 is rotatably mounted, adjacent one end 101 thereof, on a pin 102 that extends frontally from plate 95. Beneath the opposite end 103 of the upper dog 100 is a downwardly extending, beveled finger 104. The beveled finger 104 is adapted to fall downwardly, under the weight of the end 103 of the upper dog 100, between adjacent gear teeth 92 on the top of the ratchet wheel 86, including the half-gear teeth previously described, to restrict counterclockwise rotation of the ratchet wheel about the central rod 96 (when viewed as in FIG. 9). In this regard, the beveled finger 104 of the upper dog 100 can prevent the ratchet wheel 86 from rotating counterclockwise with downward movement and counterclockwise revolution of the lower dog 88*a* about the central rod 87. A finger 105 extends from the pivoted end 101 of the upper dog 100 and a finger 110 extends from the pivoted end 96 of the lower dog 88*a*.

A tab 106 is provided which extends frontally from plate 88. The tab 106 is located above the upper dog 106, adjacent its beveled finger 104. The tab 106 serves to restrict rotation of the upper dog 100 in a counterclockwise direction about the pin 102 (when viewed as in FIG. 9).

As shown in FIGS. 3 and 9, the totalizer 65 also comprises a vertically elongated slider 107 located to the left (as viewed in FIG. 9) of the pivoted ends 96 and 101 of the dogs 88*a* and 100. The slider 107 moves vertically past the lower and upper dogs 88*a* and 100 in a channel 107*a* formed between flange 107*b* of divider plate 59 and flange 107*c* on front plate 88 in the housing 52. The slider 107 has a pair of spaced parallel fingers 108 and 109, the latter at the top thereof (see also FIG. 3) and the other downwardly spaced therefrom. The parallel fingers extend toward the lower 88*a* and upper 100 dogs and fit between flange 107*c* and plate 95 for guided up and down movement therebetween. Upward movement of slider 107 is limited by stop 107*d* and downward movement of the slider is limited by fingers 105 and 110. The slider fingers 108 and 109 are adapted to urge downwardly the fingers 110 and 105, respectively, on the pivoted ends 96 and 101, of the dogs 88*a* and 100 when the slider 107 is moved downwardly, so as to: (1) cause the fingers 110 and 105 of the dogs to move downwardly and revolve counterclockwise (when viewed as in FIG. 9) about the pins 89 and 102, respectively; and (2) thereby cause corresponding upward movement and counterclockwise revolution of the beveled ends 90 and 104 of the dogs, so that such beveled ends move out of engagement with the gear teeth 92 of the ratchet wheel 86.

As disclosed in the mentioned pending application, a hub (not shown) of the ratchet wheel 86 extends rearwardly through plate 95 into the hub 110*a* of a conventional price wheel 111 of the vending controller 112 (see FIG. 3). The inside diameter of the hub 110*a* of the price wheel 111 preferably mates with the outside diameter of the ratchet wheel hub, and the rear of the price wheel hub 110*a* is preferably located adjacent to the front of the retaining plate 89*a*. By means of a key-groove connection, as disclosed in the mentioned pending application, the hub of the ratchet wheel and that of the price wheel 111 are interlocked so that rotation of the ratchet wheel hub about the central rod 87 causes corresponding rotation of the price wheel 111. It is to be understood that the rear of the price wheel 111 is provided with a conventional set of gear teeth which extend annularly about the price wheel hub. A notch, not shown, is also preferably provided in the circumferential edge of the price wheel 111. The notch is preferably located on the bottom of the price wheel when the higher gear tooth 93 abuts against the tab 94.

As additionally disclosed in the mentioned pending application, rotatably mounted about the central rod 87 and the price wheel hub 110*a*, adjacent the price wheel 111, are circular cams 113 and 114 which also comprise elements of the vending controller 66. Extending annularly about the price wheel hub 110*a* on the front and rear of each cam 113 and 114 are conventional sets of gear teeth 115. The adjacent sets of gear teeth 115 on the cams 113 and 114 mate with one another as well as with the set of gear teeth (not shown) on the price wheel 111.

Figure 18:
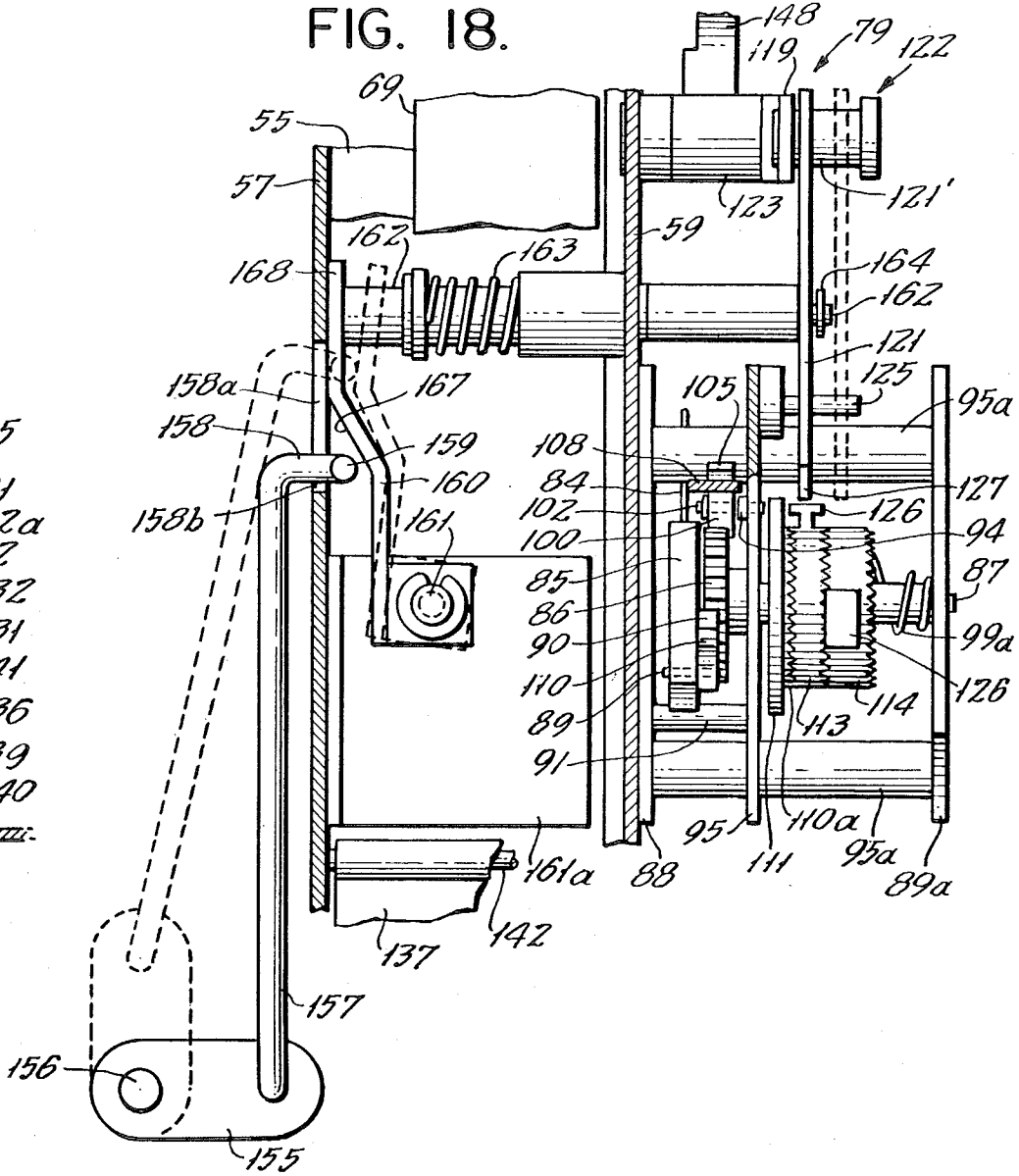
FIG. 18 is a section view along lines 18—18 in FIG. 11.

The circular cams 113 and 114 are urged frontally against each other and against the rear of the price wheel 111 by a conical coil spring 99*a* (see FIGS. 3 and 18). The spring is wrapped about the rear portions of the price wheel hub 110*a* as described in the pending application and urges the rearmost cam 114 against cam 113. With the parts interconnected as described, rotation about the central rod 87 of the ratchet wheel 86, and its hub and key, results in corresponding rotation of the groove in the price wheel hub 110*a*, with resulting rotation of the price wheel 111 with its set of gear teeth. Rotation of the price wheel gear teeth caused by rotation of the ratchet wheel 86, results in corresponding rotation of the sets of gear teeth 115 on the circular cam 113 and 114—unless the cam gear teeth 115 are disengaged from the price wheel gear teeth. The cams 113 and 114 can be disengaged from the price wheel 111 by pulling one or both cams rearwardly of the price wheel to disengage their gear teeth. For example, the cams 113 and 114 can be pulled rearwardly to disengage them from the price wheel 111 and from each other when control elements, i.e. projections on the cams are to be angularly displaced about the central rod 87 from one another and from the price wheel notch to angular positions about the central rod 87 associated with different prices for newspapers or the like, to be vended. Thus, when the price wheel notch is at the bottom of the price wheel 111, one cam control element; i.e. a projection 126 on cam 114 (see FIG. 3) can represent a higher price than another projection on the cam 113 by merely angularly displacing the one cam projection further from the price wheel notch in a counterclockwise direction (when viewed as in FIG. 3) than the other cam projection.

Assuming that each nickel rotates the ratchet wheel 86 by one gear tooth about the central rod 87, that each dime rotates the ratchet wheel by two gear teeth about the central rod and that each quarter rotates the ratchet wheel by five gear teeth, the thus measured rotation of the ratchet wheel causes corresponding measured rotation of the price wheel 111 and the circular cams 113, 114 about the central rod 87. The sum of the measured downward deflections of the end of the trip wire 84 by the deposited coins falling down the chutes 78, 79 and 80, in succession, causes the beveled end 90 and the lower dog 88*a* to revolve about the central rod 87 by a corresponding sum of measured angles and causes the ratchet wheel 86 and the price wheel 111 and the circular cams 113 and 114 to rotate about the central rod 87 by a corresponding sum of measured angles.

As will be appreciated from the foregoing disclosure, the coin totalizer associated with the coin sorter of the invention, is substantially identical to the coin totalizer and vending controller of U.S. application Ser. 489,848 excepting that instead of providing the cams 113, 114 with notches of predetermined arcuate extent in the periphery of the cams for vending control, we use projections on the cams 113, 114 for controlling the vending operation for reasons hereinafter clarified. The arcuate extent of the projections may correspond to that of the notches in the cams of the mentioned pending U.S. application.

The present invention also differs from the mentioned U.S. application in the manner in which up and down movement of the slider in its channel is controlled as will become evident from the disclosure to follow.

Figure 10:
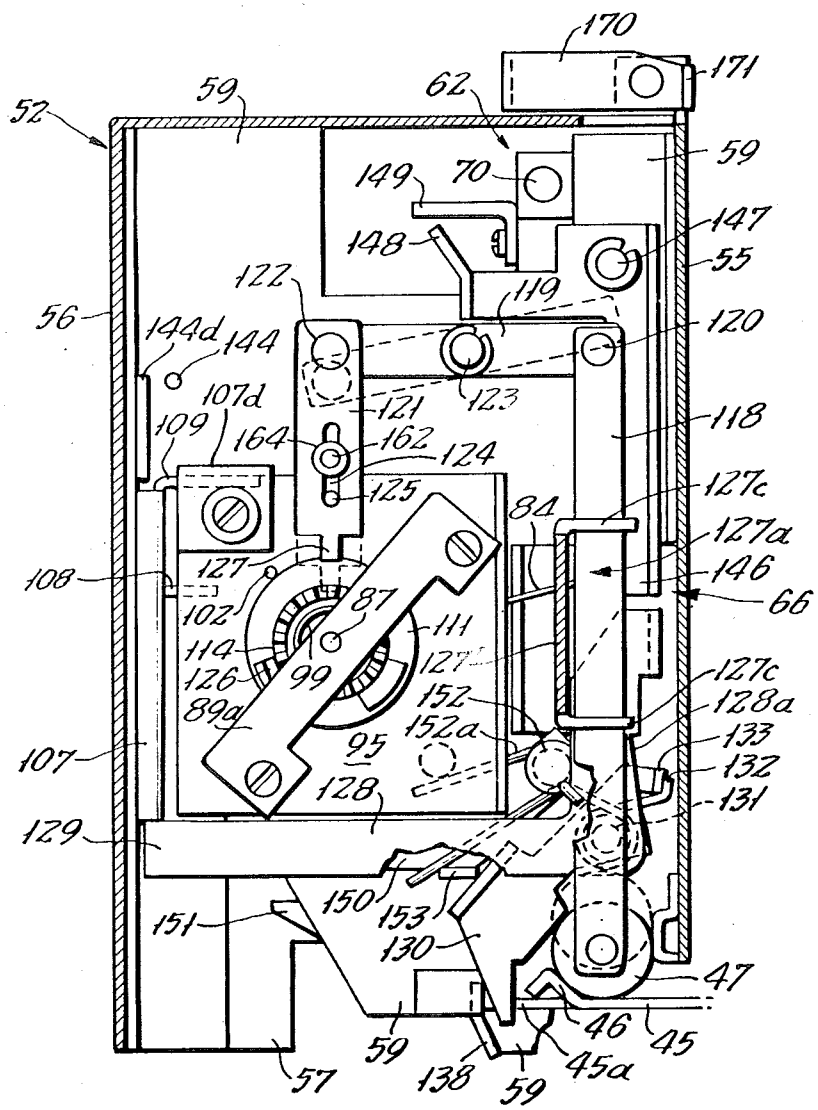
FIG. 10 is a section view along line 10—10 in FIG. 3.

FIG. 10 shows that part of the vending control means 66 which is operative when the correct amount of coins is deposited in slot 36 of the vending machine to permit unlatching of the door latch 45 from the hook 48 in the head part 28 of the vending machine.

As seen in FIGS. 3 and 10–12, the vending control means 66 includes a long arm actuator 118 to the bottom end portion of which is connected the roller 47 (also shown in FIG. 2). The roller will be seen, as viewed in FIG. 10, to be to the rear of the beveled end 46 of the door latch 45. As seen in FIGS. 3 and 10, the control means further includes an actuator lever 119 one end of which is mounted by means of a movable pivot 120 to the upper end of long arm actuator 118. The opposite end of actuator lever 119 is operatively connected to the upper end of a feeler 121 by means of movable pivot 122. Intermediate movable pivots 120 and 122, the actuator lever 119 is mounted for pivotal movement about pivot 123 fixed to the divider plate 59. The feeler 121 is formed with an elongate narrow slot 124 which receives a guide pin 125, fixed to the plate 95, which pin insures vertically guided up and down movement of feeler 121 when the long arm actuator 118 is moved downwardly and upwardly, respectively.

As seen in FIG. 10, the roller 47 is in its lowermost position dictated by pin 125 which acts as a stop against further upward movement of feeler 121 and thereby further downward movement of the long arm actuator 118 and thus the roller 47 attached thereto. For purpose of disclosure the feeler 121 is assumed to be positioned over circular cam 114 as shown in FIG. 10. As thus positioned, the door latch 45 cannot be separated from hook extension 49 because the circular cam 114 is in a position representing coin amount deposits in the machine less than the amount required for purchase of a newspaper.

As seen in FIG. 10, the beveled end of latch 45 is just forward of the roller 47 which is at its lower limit as determined by stop 125. It should be understood that to unlatch the latch 45 from hook extension 49 (not shown in FIG. 10 for clarity of illustration) the door latch 45 must be depressed an extent sufficient to free the door latch 45 from the hook extension 49. In the position of the roller 47 shown in FIG. 10 and with circular cam projection or cam dwell 126 positioned relative to the feeler extension 127 as illustrated in this figure, opening the front door 20 of the vending machine will not be possible. The reason for this will be appreciated from the dash line positions of the roller 47 and the feeler extension 127, which positions are assumed when an attempt is made to open the door without deposit of any or an insufficient amount of coins. Pulling on the door handle will cause latch 45 to move to the right as viewed in FIG. 10 to cause roller 47 to ride up the beveled end 46 of door latch 45. When roller 47 thus rides up the beveled end 46, the long arm actuator 118 will also be raised causing pivotal movement of actuator lever 119 about fixed pivot 123 in counterclockwise direction, resulting in vertically guided downward movement of the feeler 121 until its extension 127 strikes the periphery of circular cam 114. When this occurs, further upward movement of roller 47 and long arm actuator 118 cannot take place. In the dash line position of the roller shown in FIG. 10 the downward force exerted on the beveled end 46, on attempted withdrawal movement of the latch, is insufficient to move the door latch 45 downwardly a sufficient distance to free the door latch from hook extension 49 and hence further outward opening movement of the front door will be blocked because the hook extension 49 will remain in the opening 49*a* in the door latch 45 (see FIG. 2).

Figure 11:
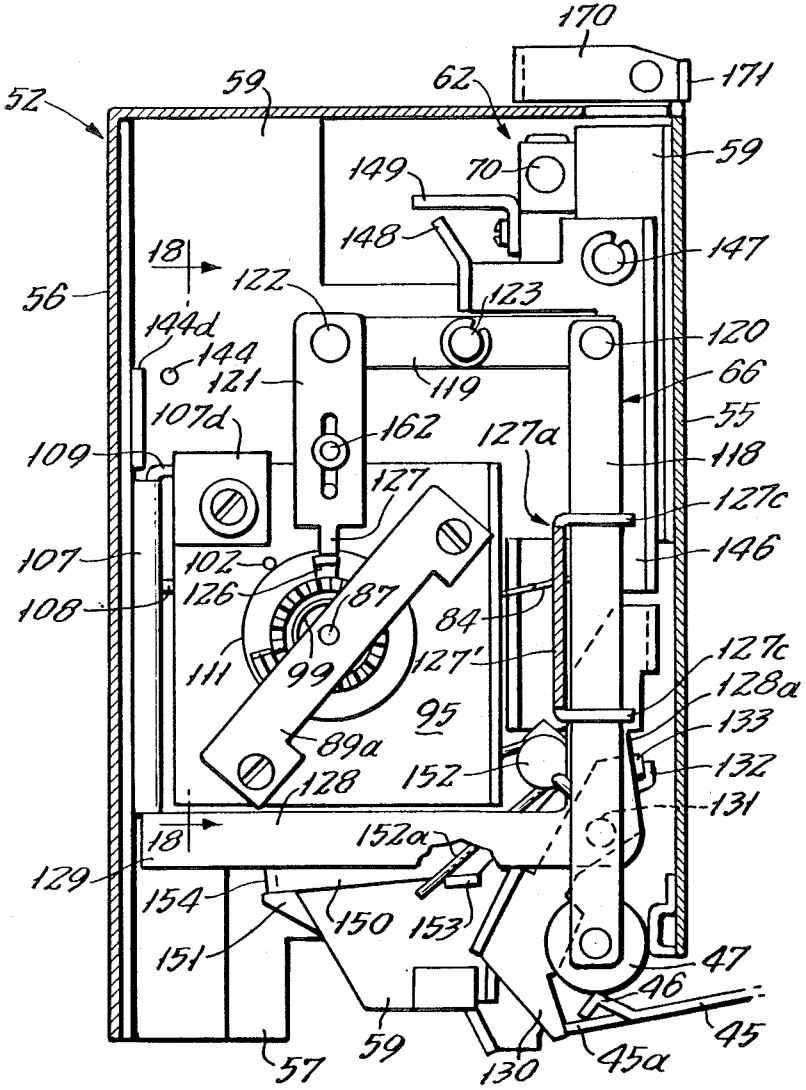
FIGS. 11 and 12 are section views similar to FIG. 10 but showing different operational states.

FIG. 11 shows the positions of the roller 47, the feeler extension 127 and the projection 126 which will enable opening the front door of the vending machine. Suffice it to say that the correct amount of coins have been deposited in the machine so that the feeler extension 127 is now in juxtaposed relation to projection 126 as shown in FIG. 11. It should be understood that before pulling the door open, the beveled end 46 and roller will be related as shown in FIG. 10, but contrary to the showing in FIG. 10, when the correct amount of coins have been deposited, there will be only a slight spacing between feeler extension 127 and projection 126. When the feeler extension 127 is thus related to projection 126, pulling the front door handle will cause the beveled end 46 to move the roller 47 upwardly to in turn move feeler extension 127 downwardly. With feeler extension 127 juxtaposed to projection 126, the latter acts as a stop preventing further upward movement of the actuator 118 and roller 47. With actuator 118 and roller 47 blocked against further upward movement, and with continued pulling of the front door in an opening direction, the roller periphery will now act as a cam surface and force the beveled end 46 of latch 45 downwardly a sufficient distance to free the door latch opening 49*a* from hook extension 49, enabling thereby unhindered door opening for access to the vendable product in the vending machine.

In FIG. 10, to ensure guided up and down movement of long arm actuator 118, we advantageously provide an L-shaped element, generally 127*a*, the shorter leg of which (not shown) is connected to flange 127*b* (see FIG. 3) of the front wall 55, with the longer leg 127' extending downwardly toward divider plate 59. The longer leg has two pairs of finger-like projections 127*c*, generally normal to the longer leg, one pair of finger projections 127*c* being fitted above and the other pair below the long arm actuator so as to straddle the same. One pair of fingers is shown at 127*c* in FIGS. 10, 11 and 12.

Figure 12:
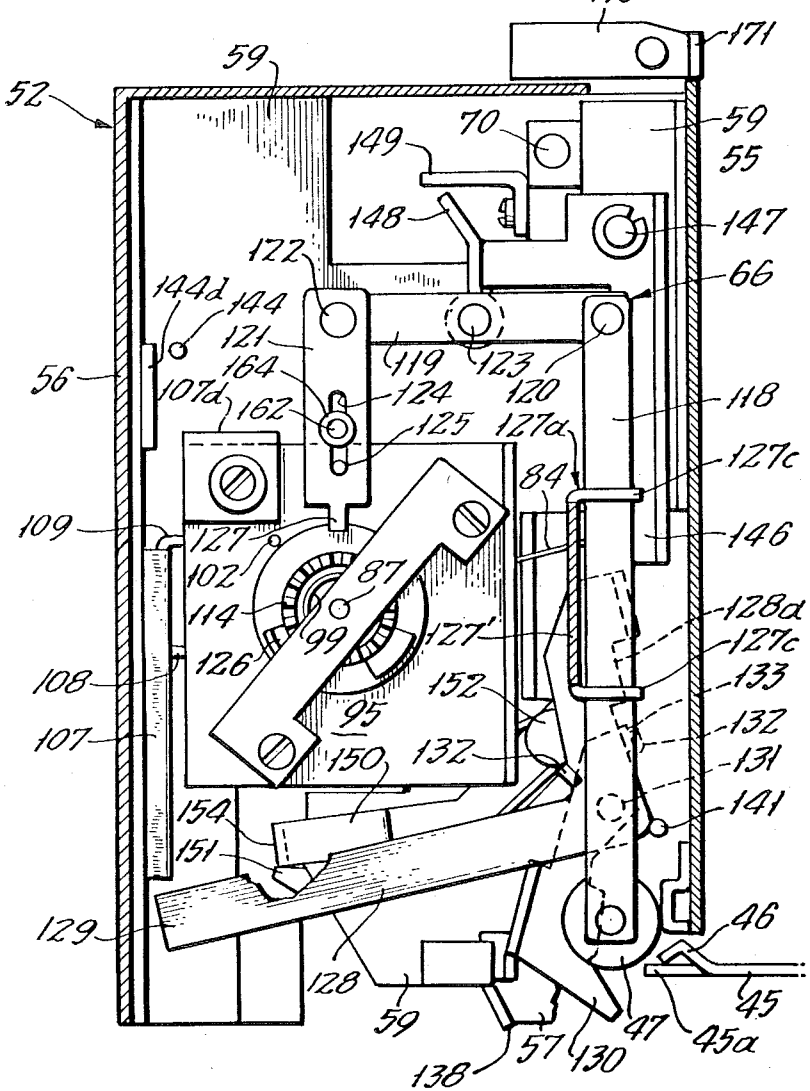

FIG. 12 shows the positions of the vending control parts after the front door latch 45 has been freed from hook 48 (not shown in this figure). The long arm actuator 118, roller 47, feeler extension 127 and circular cam 114 will be seen to have again assumed their solid line positions shown in FIG. 10. The counterclockwise rotation of circular cam 114 from its position in FIG. 11 to its position in FIG. 12 is effected on downward movement of the slider 107 during which movement, as previously described, the slider parallel fingers 108, 109 engage the dogs 88*a* and 100 in the totalizer 65 to release the dogs from the teeth 92 of the ratchet wheel 86. With the dogs thus released from the teeth, torsion spring 99 rotates the ratchet wheel 86 counterclockwise and thereby also the price wheel 111 and the circular cams 113, 114 to reset the ratchet wheel, the price wheel 111 and the circular cams for a following newspaper purchase.

Figure 14:
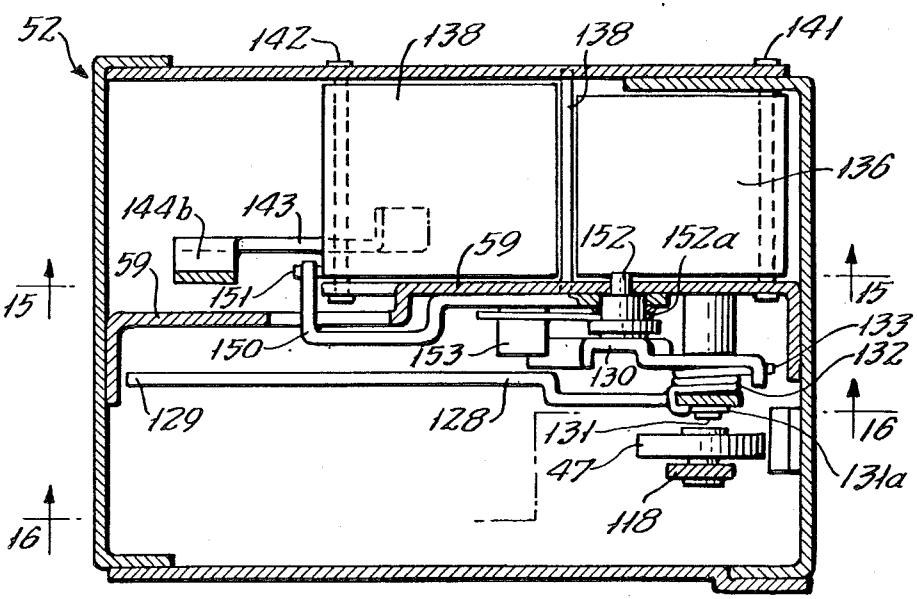
FIG. 14 is a section view along lines 14—14 in FIGS. 2 and 15.

Up and down movement of the slider 107 is controlled by a generally L-shaped reset lever 128, an end portion 129 of which underlies the slider (see FIGS. 10, 11 and 12), and a cooperating operating lever 130 engageable by the latch 45 on reclosing the front door after purchase of a newspaper. When the front door latch is moved from its position in FIG. 10 to that in FIG. 12 the operating lever 130, mounted for pivotal movement about an upstanding shaft 131 fixed to divider plate 59, rotates counterclockwise (as viewed in FIG. 12) under urging of a spring 132 and partially under its own weight. The reset lever 128 is mounted on the same upstanding shaft 131 above the operating lever 130 and spaced therefrom by the spring 132 which as seen in FIGS. 3 and 14 comprises a coil spring, the ends of which interconnect the reset lever 128 and the operating lever 130 to ensure movement of the reset lever 128 with the operating lever 130. To this end, the operating lever 130 is provided with an upstanding tab 133 which in FIG. 10 is shown spaced from the reset lever 128. Coil spring 132 is under maximum tension when the tab 133 is positioned as shown in FIG. 10. Accordingly, when the latch 45 is moved from its position in FIG. 10 to the unlocked position shown in FIGS. 11 and 12 the spring will cause the operating lever 130 to initially rotate counterclockwise relative to the reset lever 128 until the tab 133 engages leg 128*a* of the reset lever 128. When the tab engages the reset lever 128, the latter will be forced by the tab to follow the counterclockwise movement of the control lever until the reset lever is moved to the position shown in FIG. 12. The weight of the operating lever also contributes to the counterclockwise movement thereof as does also the reset lever. When the latch 45 is moved from its position in FIG. 12 to its FIG. 10 position, the latch engages the operating lever and forces it clockwise about pivot shaft 131. Because of the interconnection by the coil spring of the common shaft mounted control lever and reset lever, the reset lever will follow the clockwise movement of the operating lever and will effectively positively be held in the horizontal position shown in FIG. 11 when the tab 133 is forced, against the bias of spring 132, from leg 128*a*.

Downward movement of the reset lever 128 (and corresponding movement of the operating lever 130) is limited by the action of spring 132 and enables the slider 107 to reset the ratchet wheel 86, the price wheel 111 and the circular cams 113, 114 as previously described. Upward movement of the reset lever (and the corresponding movement of the operating lever 130) is limited by the action of stop 107*d* (see FIG. 9) and causes upward movement of the slider to position its fingers 107, 108 as shown in FIG. 9.

Figure 13:
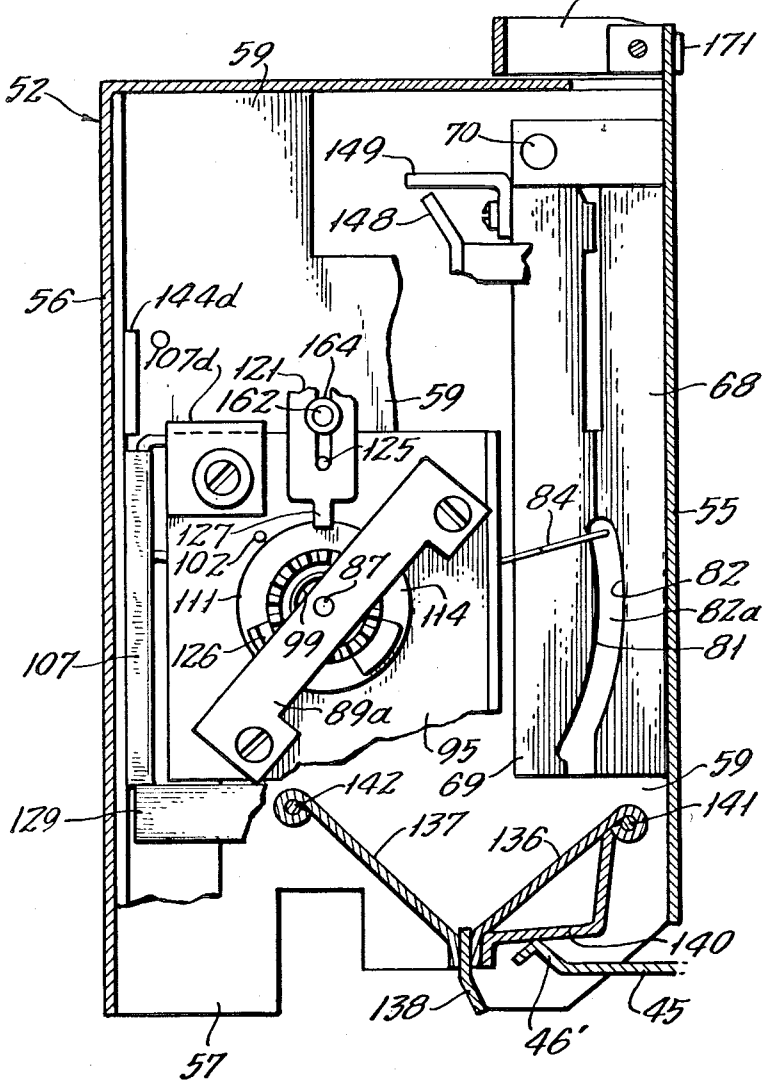
FIG. 13 is a section view along lines 13—13 in FIG. 3.

Referring to FIG. 13, this figure shows a left hand side view of the two-part coin sorter of the invention, the slot 67 in which (not shown in this FIGURE) faces the front wall 55 of the housing and is in alignment with the slot therein. As will be seen in this figure, an escrow container is located below the coin sorter for receiving the coins passing down the chutes 78, 79 and 80 (not shown in this FIGURE) and out through coin openings 78*a*, 79*a* and 80*a* (not shown in this FIGURE) in the rear of the rear sorter part 69. The escrow container comprises an escrow accept flap 136 and a reject flap 137. When the door latch 45 is in its latched position (the hook 48 has been omitted for clarity of illustration), as shown in FIG. 13, the accept and reject flaps 136, 137 engage a divider element 138 fixed to divider plate 59. When thus positioned, coins exiting the coin sorter will fall into the escrow container. As seen in FIG. 13, the escrow accept flap 136 has fixed to its underside, as by welding, a generally V-shaped extension 139 one leg 140 of which is adapted to be engaged by beveled end 46' of the door latch 45 as shown in FIG. 13. Beveled end 46' is to be understood to be laterally spaced from and in line with the beveled end 46 which cooperates with the roller 47. Also as will be appreciated from FIGS. 10 and 11, a medial part of the latch **45*a* between beveled ends 46 and 46' cooperates with the operating lever 130 as previously described. The escrow flap 136 is mounted for pivotal movement about pivot 141 (see also FIG. 14). Similarly, the escrow reject flap 137 is mounted for pivotal movement about pivot 142. When the correct amount of coins has been deposited in the vending machine and a purchaser begins to open the front door 20 of the vending machine for access to a newspaper, the door latch 45 will gradually be withdrawn from the head part 28 and will ultimately be moved to a position free of the V-shaped extension 139 of the escrow accept flap 136. When this occurs, the escrow accept flap 136 will pivot under its own weight (and the weight of the coins therein) about pivot 141 in a counterclockwise direction away from fixed escrow divider 138** and the coins in escrow will be collected in coin collection means (not shown).

Conversely, when closing the front door 20, beveled end 46' of the door latch will engage leg 140 of the V-shaped extension 139 and move the escrow accept flap 136 clockwise about pivot 141 until it abuts against divider 138 as shown in FIG. 13. With the escrow accept flap 136 thus positioned, the vending machine, with the ratchet wheel 86, price wheel 111 and cams 113, 114 reset as previously described, will be ready for the next vending operation.

Figure 15:
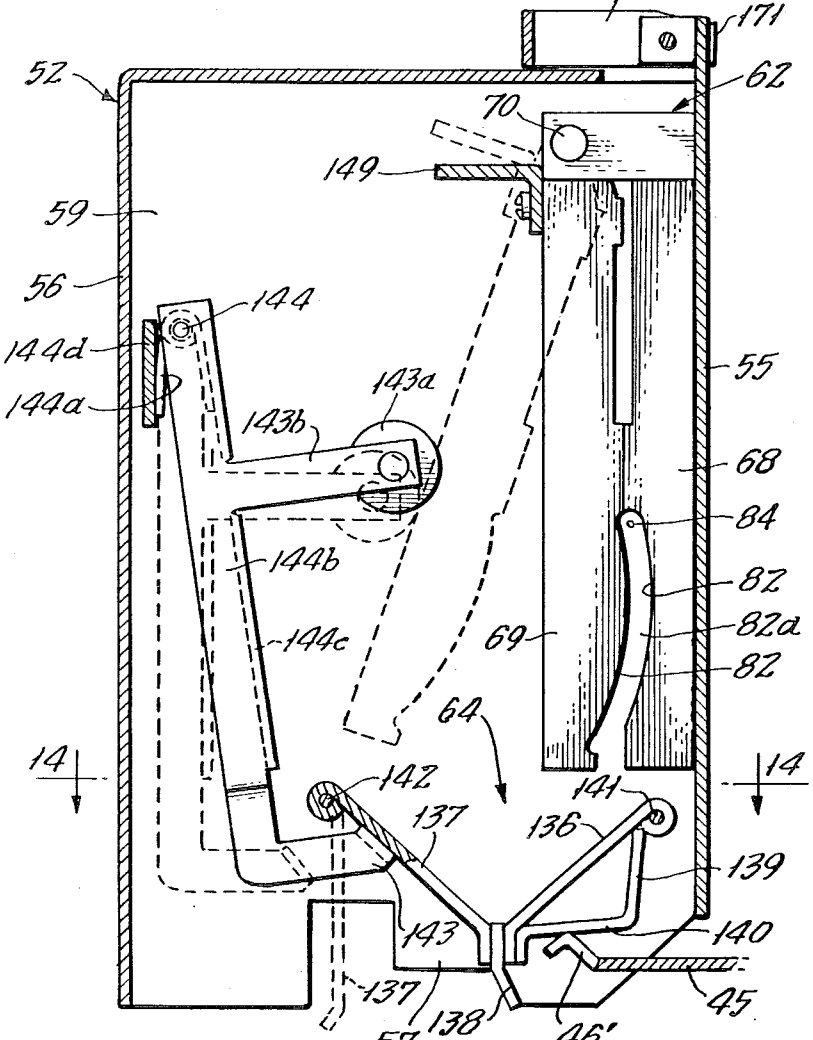
FIG. 15 is a section view along lines 15—15 in FIG. 14.

Referring to FIGS. 14 and 15, the reject flap 137 is held against the escrow divider 138 under action of a lever arm 143 which laterally extends from an elongated flanged element **144*b* is normally urged counterclockwise by spring 144*a* about a fixed pivot 144, fixed to the divider plate 59. The spring 144*a* has one of its ends bearing on flange formation 144*c* on element 144*b* and its other end bearing on an upstanding plate 144*d* welded to the divider plate 59. Should a purchaser elect not to purchase a newspaper after deposit of the correct, or less than the correct, amount of coins in the vending machine, operation of the coin return button 38, by pushing it inwardly, causes the rear sorter part 69, by means more fully hereinafter described, to rotate clockwise (as viewed in FIG. 15) about pin means 70, against the bias of spring means 71 (see FIG. 3) to engage a roller 143*a* rotatably supported by an arm 143*b* laterally extending from the flanged element 144*b* above and in the same direction as lever arm 143. The rear sorter part 69 when it engages roller 143*a* moves the lever arm 143 about pivot 144 in a direction, shown in dotted lines, away from the reject flap 137. With the lever arm 143 in its dash line position, the reject flap will rotate clockwise, as viewed in FIG. 15, under its own weight (and that of the coins in escrow) about its pivot 142 and thus out of engagement with the escrow divider 138. If desired, a spring may be provided about pivot 142 to positively urge the reject flap in a clockwise direction when the lever arm 143 is moved clockwise. In the dotted line position of the reject flap 137, coins held in escrow will be routed to the coin return opening 42 in the front of the machine for return to the purchaser. On release of the coin return button 38, the rear sorter part 69 will move counterclockwise about pin means 70 under action of spring 71 to return to its solid line position in FIG. 15. With the sorter part 69 in its solid line position, lever arm 143 will move counterclockwise about fixed pivot 144 into engagement with reject flap 137** to return it from its dotted to its solid line position.

Figure 16:
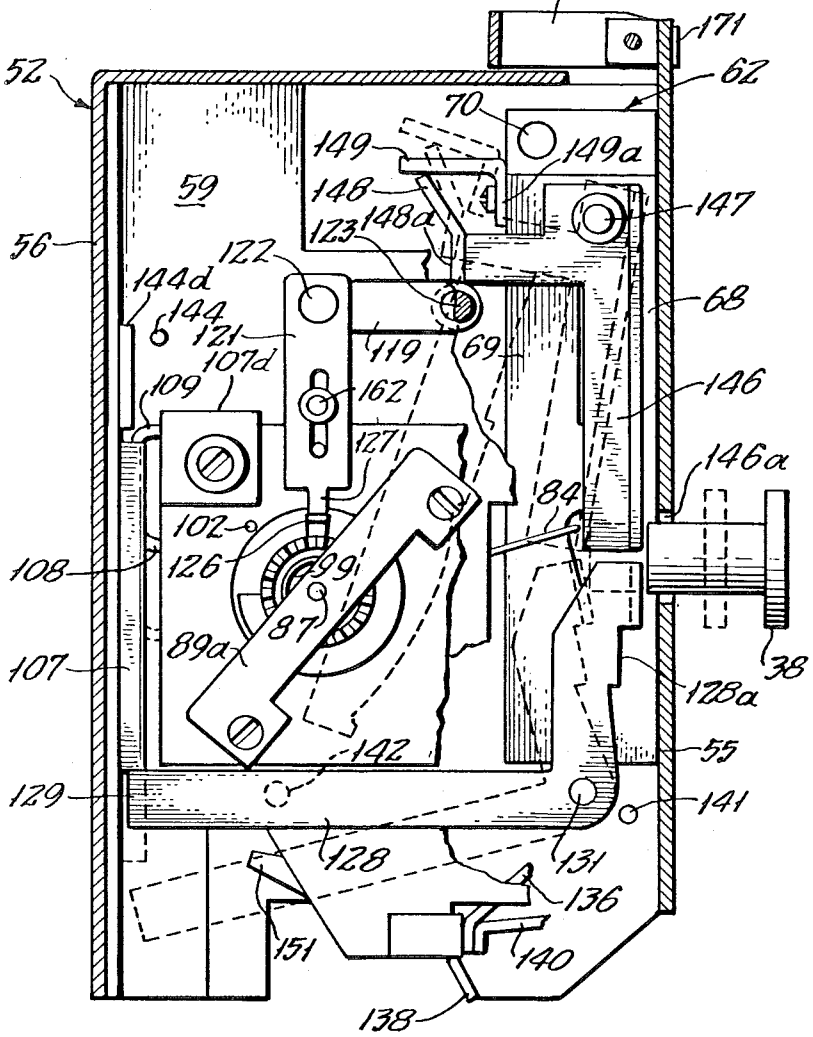
FIG. 16 is a section view along lines 16—16 in FIG. 14.

FIG. 16 for clarity of illustration omits a showing of the operating lever 130, a lock-out member to be described and the coil spring 132 operatively connected with the reset lever. This figure shows the means effective to move the rear sorter part 69 from its solid to its dash line position in FIG. 15 on operation of the coin return button 38. Such means comprises an inverted generally "L" shaped member 146 mounted for movement about pivot 147 fixed to the divider plate 59 on that side thereof facing compartment 61 and spring urged in a counterclockwise direction as viewed in FIG. 16. Member 146 will be seen in FIG. 16 to have its lower end in register with the opening **146*a* in the front wall 55 of the housing 52. The free end of the horizontal leg of the "L" shaped member 146 has an upwardly directed tab 148 which is spaced from the horizontal leg 149 of an L-shaped bracket, the vertical leg 149*a* of which is fixed by suitable means; i.e. by screws, to the rear face of the rear sorter part 69. The horizontal leg 149 of the bracket extends laterally beyond the rear sorter part 69 in a direction toward side wall 58. As will be appreciated from FIG. 16, pushing coin return button 38 inward, urges member 146 clockwise about pivot 147 causing finger tab 148 to bear against the horizontal leg 149 of the bracket with sufficient force to overcome the bias of spring 71. When the bracket is thus engaged, the rear sorter part 69 is rotated to its dash line position in FIG. 15 in which position penny coins and/or slugs dropped in the coin sorter are released and routed to the coin return receptacle of the vending machine. The horizontal leg of member 146 also has a downwardly extending tab 148*a* which bears on the fixed pivot 123 when the coin return button 38 is not operated, fixed pivot 123 in such case serving as a stop which limits counterclockwise rotation of member 146**.

The reset lever 128 as shown in FIG. 16 is also in register with opening **146*a* in the front wall 55. Accordingly, on inward pushing of the coin return button 38 against the reset lever 128 the latter is caused to rotate counterclockwise about pivot 131 as viewed in FIG. 16. When thus moved, the reset lever 128 will assume its inclined position shown in dash lines. In this position of the reset lever 128 the slider 107 descends under its own weight causing finger tabs 109, 108 thereon to engage fingers 105 and 110 on dogs 100 and 88*a*, respectively, to disengage these dogs from ratchet teeth 92 thereby enabling resetting of the ratchet wheel 86, the price wheel 111 and the circular cams 113, 114, as previously described. Since the front door of the vending machine will be closed when the coin return button 38 is operated, operating lever 130 will remain in its position shown in FIG. 10 because the latch 45 in its latched position prevents the operating lever 130 from counterclockwise movement about pivot 131. Accordingly, the reset lever 128 will be understood to be moved to its inclined position (as in FIG. 12) by button 38 against the force of spring 132**.

A situation can arise where an individual, having inserted the correct amount of coins into the machine, attempts to get both a newspaper and the return of his coins. This may occur if the coin return button 38 is operated at precisely the same time an attempt is made to open the front door of the vending machine. To prevent this from occuring, we provide in accordance with the invention, a lock-out mechanism now to be described with respect to the FIG. 17.

Figure 17:
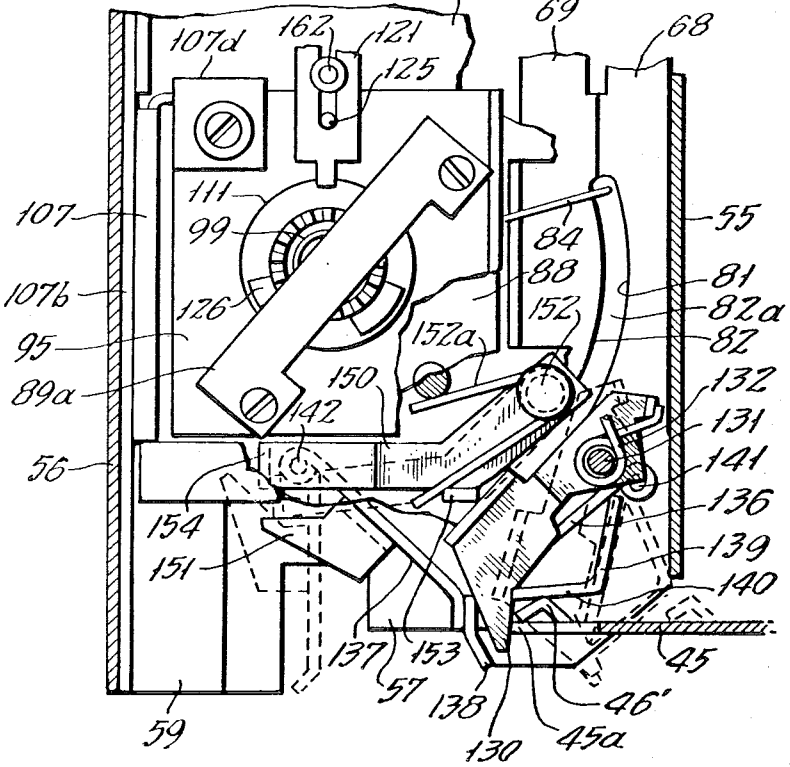
FIG. 17 is an elevation view with the left side wall of the housing removed, of parts just below the totalizer looking in the direction of the divider plate of the housing for a lock-out operation in accordance with the invention.

Referring to FIG. 17, we provide in addition to the operating lever 130 and the reject flap 137, a lock-out member 150 which cooperates with the reject flap 137 to "lock" the latter against movement clockwise about pivot 142 should an attempt be made to open the front door of the vending machine simultaneously with the operation of button 38. Assuming the correct amount of coin deposits has been made, if the purchaser elects to have his coins returned (without simultaneously attempting to open the front door) operation of the coin return button 38 will result in return of the coins as previously described.

Should the purchaser elect to purchase a newspaper after deposit of the correct amount of coins, the purchaser need only pull open the front door of the machine to release the latch 45 from the hook 49, also as previously described. On withdrawal movement of latch 45, accept flap 136 rotates counterclockwise about pivot 141 as previously described, to release the coins for collection.

It is to be borne in mind that should button 38 be operated simultaneously with the opening of the front door, in the absence of the lock-out member 150 of the invention, both the accept flap 136 and reject flap 137 could conceivably be released, the former because it will rotate counterclockwise about pivot 141 on removing latch 45 from the head part 28 of the machine, and the latter when the inhibiting action of the lever 143 is removed from the reject flap 137 under action of button 38, as previously described with respect to FIG. 15. To prevent the reject flap 137 from rotating clockwise about its pivot 142, only when the coin return button 38 is operated simultaneously with the attempted opening of the front door of the vending machine, the reject flap 137 is provided with a lateral projection 151 which is adapted to be engaged by the lock-out member 150. The operation is as follows.

The lock-out member 150, due to its mounting on a spring loaded pivot 152, is normally urged under action of spring **152*a* in counterclockwise direction as viewed in FIG. 17. When the door latch 45 is in its latched position within the head part of the machine, the operating lever 130 will be in its solid line position. The lock-out member 150 has a tab 153 which in the solid line position of the operating lever abuts the operating lever 130, so that the left hand end 154 of the lock-out element, as viewed in FIG. 17, is spaced from the lateral projection 151. When the latch is removed from the head part, the operating lever 130 will move to its dash line position enabling lock-out member 150 to move counterclockwise to its dash line position about pivot 152 into engagement with lateral projection 151 to thereby hold the reject flap 137 in its "locked" position. The lock-out member 150 will therefore hold the reject flap in its locked position when the lever arm 143 is pivoted clockwise away from reject flap 137 on operating coin return button 38. It should be noted that the lock-out member 150 does not interfere with the normal cooperative action of the reject flap 137 and lever arm 143, as occurs on operating coin return button 38 when the front door of the vending machine is closed, and no attempt is made to open the front door, because the operating lever 130 when the front door is closed is urged to its solid line position against the tab 153 of the lock-out member, thus preventing the latter from engaging the lateral projection 151**.

Because weekday prices of newspapers differ from Sunday prices, which are higher, we also provide means enabling price selection.

Alternative prices are preset for newspapers by pulling the circular cams 113, 114 rearwardly of the price wheel 111 and its gear teeth and simultaneously rotating the cams 113, 114 about the hub **110*a* (FIG. 3) until their projections 126 are at different angles about the hub 110*a* from each other, from a notch (not shown) in the price wheel 111 and from the high gear tooth 93 on the ratchet wheel 86. Such different angles of the projections 126 correspond to different prices for the newspapers. The price selector lock 40** in the head part of the machine enables price selection.

Referring to FIG. 18, a plate 155 is mounted on a shaft 156, rotatable by the selector lock 40, the plate 155 being movable between two positions by price selector lock 40. FIG. 18 shows the low price position or the weekday setting of the feeler 121 in solid lines while the dash line setting of feeler 121 corresponds to the high price or Sunday setting. Connected to the plate 155 for movement therewith is a generally inverted L-shaped rod 157. The lock 40, plate 155, shaft 156 and the longer leg of the L-shaped rod are external to the housing 52 except for, an upper lateral extension 158 of the rod 157 which extends into the housing through an L-shaped opening formed in the side wall 57, the vertical leg portion of the L-shaped opening being shown at **158*a* and the horizontal leg portion at 158*b*. The lateral rod extension 158 terminates in a reversely bent portion 159 adapted to bear against the price lever 160 mounted for movement about pivot 161 fixed to an L-shaped bracket 161*a* welded to the side wall 57**.

To mount the rod 157 in operative relation to the price lever 160 the lateral extension 158 and reversely bent portion 159 are first introduced into the horizontal leg portion **158*b* of the L-shaped opening while the plate 155 is loosely connected to shaft 156 for movement relative thereto. The lateral extension 158 is then slightly raised for entry into the vertical leg portion 158*a* of the L-shaped opening by turning plate 155 counterclockwise relative to shaft 156. With the lateral extension thus positioned, plate 155 is fixed to shaft by suitable means for movement between its solid and dotted line positions on turning price selector lock 40 from a low price to a high price setting to respectively move the lateral extension 158 from its solid to its dash line position as shown in FIG. 18. Reversely bent portion 159 prevents withdrawal of the rod 157 from the inner confines of the assembly so long as the lateral extension 158 is in the vertical leg portion 158*a* in a position above the horizontal leg portion 158*b***.

The upper end of the price lever 160 is adapted to bear against price selector shaft 162 which as seen in FIG. 18 is spring urged by spring 163 to the left as viewed in FIG. 18. The right-hand end of the price selector shaft 162 passes through the slot 124 in the feeler (see FIGS. 10 to 12), a lock ring 164 on selector shaft 162 preventing withdrawal movement of shaft 162 through slot 124. The upper end of feeler 121 has an opening (not shown) for fitting to a bushing 121' fixed to actuator lever 119.

With plate 155 in the solid line position shown in FIG. 18, the feeler 121, will overlie circular cam 113. As previously described, upward movement of long arm actuator 118 will cause downward inclined movement of actuator lever 119 about the fixed pivot 123, the extent of movement depending on whether the feeler extension 127 overlies the relieved peripheral section of the circular cam or its projection 126. As the actuator lever 119 moves downward (as viewed in FIG. 18) about fixed pivot 123 it carries with it feeler 121, the movement of which is guided by guide pin 125 (see FIG. 10) as previously described.

If a higher price is to be selected, the price selector lock 40 is turned to move plate 155 to its dash line position causing the lateral extension 158 to ride upwardly on inclined ramp 167 into engagement with the vertical extension 168 of price lever 160 to force the price lever shaft 162, and thereby the feeler 121 movably fitted to shaft 162, to the right to its dash line position against the bias of spring 163. The feeler, when thus moved overlies circular cam 114. Since the vending control operation with the feeler 121 overlying the circular cam 114 is the same as the vending control operation previously described with the feeler 121 overlying the circular cam 113, this phase of the operation will not be repeated.

Figure 20:
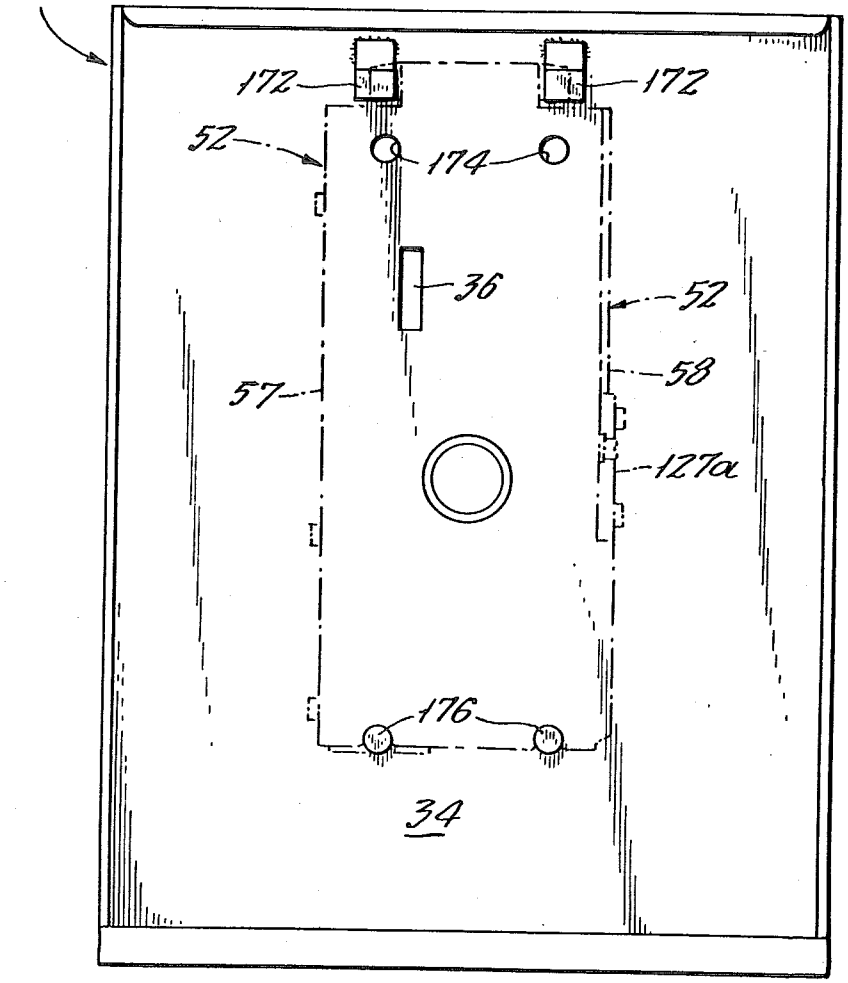
FIG. 20 is a rear view of the head part of the vending machine with the top and rear walls removed.
Figure 19:
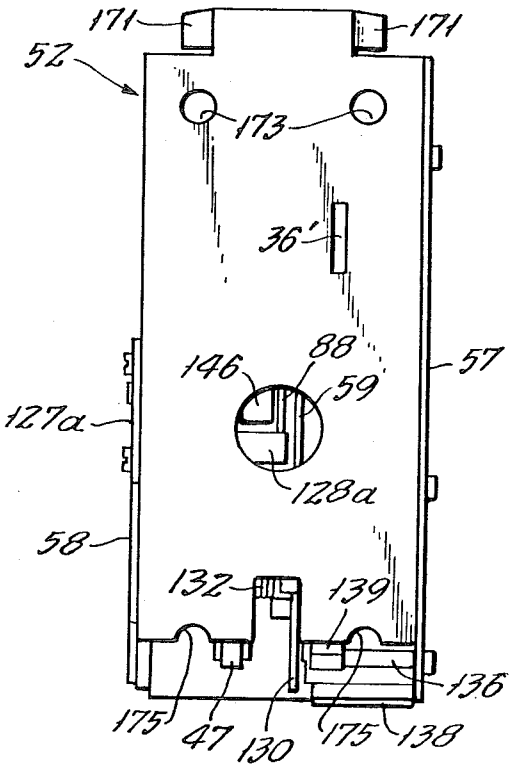
FIG. 19 is a front elevation view of the coin operated assembly of the invention.

FIGS. 2, 19 and 20 show the means for mounting the coin operated assembly to the rear side of the front wall 34 of the head 28. Such means includes a handle-shaped element 170 pivotally mounted at the forward upper end of the assembly, the handle-shaped element having oppositely directed extensions 171 adapted to be received in struck-out portions 172 in the rear side of the front wall. The front face of the assembly, in addition to coin slot 36'; which is in register with coin slots 36 and 67 in the head 28 and the coin sorter, respectively, is provided with a pair of circular openings 173 which receive a pair of rivets 174 on the rear side of the front wall, the front face of the assembly at its bottom edge additionally being formed with a pair of semi-circular recesses 175 adapted to be seated on an additional pair of rivets 176 on the rear side of the front wall 34.

To mount the assembly to the rear sides of the front wall, the front face of the assembly is brought against the rear face of the front wall 34 of the head 28 with the semi-circular recesses 175 and circular openings in alignment with rivets 176 and 174 respectively. As the openings and recesses are positioned over their respective rivets for support thereby the handle-shaped element 170, which initially is in an upright position, is rotated counterclockwise, as viewed in FIG. 2, so that its oppositely directed extensions 171 are received in struck-out portions 172 to securely fix the coin operated assembly to the rear side of the front wall of the head 28.

To remove the assembly, the handle-shaped part is moved clockwise about its pivot to move extensions 171 out of the struck-out portions 172. The assembly can then be separated from rivets 174, 176.

Although the invention has been described in relation to modification of an existing vending machine utilizing coin stacking devices by substituting therefore the coin totalizer assembly of the invention, it will be apparent the invention is not so limited. Thus, entirely new production models may be constructed in accordance with the teachings of this invention.

What is claimed is:

1. A coin sorter for a coin operated vending machine; comprising two elongated parts defining a chamber there between, means supporting said elongated parts with one of them movable relative to the other to open said chamber, the other of said elongated parts having a coin entry slot formed therein communicating with said chamber adjacent one end thereof, said one elongated part having first and second exit openings formed therein, coin exit means forming first and second coin exit chutes between said chamber and respective first and second exit openings formed in said one elongated part; and coin guiding means comprising flap means and ramp means in said chamber, said flap means including at least a first flap and means movably supporting and biasing said first flap to its rest position, said ramp means including a first pair of spaced ramps having inclined surfaces extending substantially in a first plane and spaced so as to engage and guide a first coin of a predetermined minimum size to said first coin exit chute and thereby deflect said first flap from its rest position, said first flap being biased so that it is not moved from its rest position by a second coin too small to bridge the distance between said first pair of ramps and guides said second coin to said second coin exit chute.

2. The coin sorter of claim 1 wherein said flap means includes a second flap, said flap supporting and biasing means movably supporting said second flap and biasing the same to a rest position spaced from the first flap rest position, said second flap being movable out of its rest position in a direction away from said first flap rest position, said one elongated part having a third exit opening formed therein, said coin exit means forming a third exit chute between said chambers and the third exit opening formed in said one elongated part, said ramp means including a second pair of spaced ramps having inclined surfaces extending substantially in a second plane and spaced a distance too great to be bridged by said first coin and to engage and guide a third coin of a predetermined minimum size larger than said first coin, said second ramps being inclined at an angle to cause a third coin passing there along to deflect said second flap from its rest position and to guide said third coin to said third coin exit chute, said second flap in its rest position cooperating with said first flap to guide said second coin to said second coin exit chute.

3. The coin sorter of claim 2, wherein said coin exit chutes are formed in said elongated parts.

4. The coin sorter of claim 3, wherein said coin exit chutes have different length in a predetermined direction corresponding to the size of the respective coins guided thereto so that coins of different size travel different distances.

5. The sorter of claim 4, wherein said first and second planes intersect at an angle of about 120 degrees.

6. The coin sorter of claim 4, wherein said elongated parts define a path for a trip wire to extend across said coin exit chutes and to be moved by each of said coins through a distance corresponding to the length of said chutes traversed by the coins.

7. A coin operated assembly adapted for mounting in a coin operated vending machine having a vending door and latch means therefor, said assembly comprising (a) a housing having a coin entry opening adjacent an upper end thereof for receiving coins deposited in said vending machine when said housing is mounted in said vending machine; cooperating coin sorter means, coin totalizer means and vending control means mounted in said housing;

(b) said coin sorter means comprising two elongated parts defining a chamber therebetween, means supporting said elongated parts with one of them movable relative to the other to open said chamber, the other of said elongated parts having a coin entry slot formed therein communicating with said coin entry opening and with said chamber adjacent one end thereof, said one elongated part having first and second exit openings formed therein, coin exit means forming first and second coin exit chutes between said chamber and respective first and second exit openings formed in said one elongated part; and coin guiding means comprising flap means and ramp means in said chamber, said flap means including at least a first flap and means movably supporting and biasing said first flap to its rest position, said ramp means including a first pair of spaced ramps having inclined surfaces extending substantially in a first common plane and spaced so as to engage and guide a first coin of a predetermined minimum size to said first coin exit chute and thereby deflect said first flap from its rest position, said first flap being biased so that it is not moved from its rest position by a second coin too small to bridge the distance between said first pair of ramps and guides said second coin to said second coin exit chute, said coin exit chutes having different lengths so that coins of different size travel distances corresponding to the value of said coins;

(b) said coin totalizer means being responsive to the cumulative value of coins passing through said coin exit chutes for controlling said vending control means to permit opening of said vending door only after the deposit of coins having a cumulative value equal to a set price, said coin totalizer means comprising cam means movable from its starting point to a predetermined position upon completion of deposit of coins equal to said set price and reset means responsive to opening of said vending door for resetting said cam means to its starting point; and (c) said vending control means being positioned in said housing for controlling said vending door latch means to permit opening of said vending door only while said totalizer cam means is in said predetermined position.

8. The assembly of claim 7, wherein said totalizer means includes trip means and means responsive to said trip means for moving said cam means, and said coin sorter means forms a path for said trip means extending through said coin exit chutes so that actuation of said trip means corresponds to the distance traveled by said coins in their respective chutes.

9. The assembly of claim 8 wherein said cam means comprise a cam dwell and said vending control means comprise an interconnected feeler and a roller, said feeler engaging said cam dwell when said cam means is in its predetermined position and said roller causing said vending door latch means to unlatch said vending door as it is drawn open.

10. The assembly of claim 9 wherein said coin totalizer means includes two cam means each having a cam dwell movable to first and second set price positions upon deposit of coins equal to the set prices, and price setting means for aligning said feeler with a selected one of said cam means and its dwell.

11. The assembly of claim 8, wherein said trip means comprises a weighted lever and a trip wire extending therefrom across said path.

12. The assembly of claim 7 wherein said vending machine has a coin return button and said reset means in response to actuation of said coin return button resets said cam means to its starting point, and coin return means responsive to actuation of said coin return button and to said vending door remaining latched for returning deposited coins, said coin return means including means for moving said one elongated sorter part to open said sorter chamber for the release of any coins therein.

* * * * *